US010716368B2

(12) United States Patent
DeRue et al.

(10) Patent No.: US 10,716,368 B2
(45) Date of Patent: Jul. 21, 2020

(54) SLIDER INSERTION APPARATUS AND METHODS

(71) Applicant: Reynolds Presto Products Inc., Lake Forest, IL (US)

(72) Inventors: Nicholas A. DeRue, Farmington, NY (US); Gregg Thompson, Canandaigua, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 96 days.

(21) Appl. No.: 15/687,982

(22) Filed: Aug. 28, 2017

(65) Prior Publication Data

US 2019/0059526 A1 Feb. 28, 2019

(51) Int. Cl.

| | |
|---|---|
| ***A44B 19/64*** | (2006.01) |
| ***B31B 70/74*** | (2017.01) |
| ***B31B 70/81*** | (2017.01) |
| ***B65D 33/25*** | (2006.01) |

(52) U.S. Cl.

CPC ..... *A44B 19/64* (2013.01); *B31B 70/74* (2017.08); *B31B 70/8131* (2017.08); *B65D 33/2591* (2013.01)

(58) Field of Classification Search

CPC ..... A44B 19/62; A44B 19/64; B31B 70/8131; B31B 70/74; B65D 33/2591

See application file for complete search history.

(56) References Cited

U.S. PATENT DOCUMENTS

| | | | | |
|---|---|---|---|---|
| 5,442,838 | A | 8/1995 | Richardson et al. | |
| 5,896,627 | A | 4/1999 | Cappel et al. | |
| 6,161,271 | A | 12/2000 | Schreiter | |
| 6,199,256 | B1 * | 3/2001 | Revnew | A44B 19/62 29/408 |
| 6,216,423 | B1 * | 4/2001 | Thieman | B65B 9/06 53/133.4 |
| 6,460,238 | B1 | 10/2002 | LaRue et al. | |
| 6,517,473 | B1 * | 2/2003 | Cappel | A44B 19/62 493/212 |
| 6,622,353 | B2 | 9/2003 | Provan et al. | |
| 7,219,481 | B2 | 5/2007 | Buchman et al. | |
| 8,752,356 | B2 | 6/2014 | Bohn et al. | |
| 2005/0015957 | A1 * | 1/2005 | Savicki | A44B 19/62 29/409 |

OTHER PUBLICATIONS

International Search Report and Written Opinion for Application No. PCT/US2018/048288 dated Nov. 23, 2018, 14 pages.

* cited by examiner

*Primary Examiner* — Lee A Holly

(74) *Attorney, Agent, or Firm* — Merchant & Gould P.C.

(57) ABSTRACT

An apparatus and method for operably mounting a slider onto a recloseable plastic zipper closure includes a rotor having at least one slider-engaging shoulder; an insertion wedge adjacent to the rotor and sized to slidably accommodate the slider for mounting onto a zipper closure; and a zipper guide member adjacent to the rotor and adjacent to the insertion wedge for guiding and holding a zipper closure while the slider is mounted thereon. The insertion wedge will have a leading edge and a trailing edge and increase in thickness from the leading edge to the trailing edge. The apparatus can be vertically oriented or horizontally oriented.

33 Claims, 11 Drawing Sheets

SLIDER INSERTION APPARATUS AND METHODS

TECHNICAL FIELD

This disclosure relates to an apparatus for mounting a slider onto a recloseable plastic zipper closure and methods for doing so.

BACKGROUND

Many packaging applications use resealable containers to store or enclose various types of articles and materials. These packages maybe be used to store food products, non-food consumer goods, medical supplies, waste materials, and many other articles. Resealable packages are convenient in that they can be closed and resealed after the initial opening to preserve the enclosed contents.

Some types of resealable packages include bags made from polymer and include a plastic zipper having two interlocking profiles and a slider for opening and closing the zipper. Typically, the slider straddles the zipper and has a separating finger or plow at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Manufacturing and production of resealable zippers with slider devices can be costly and time consuming. It is desirable provide an apparatus that overcomes the problems in the prior art, including an apparatus that automatically inserts sliders on zippers at a rate that keeps up with the production rate of the overall bag making machines. It is further desirable that such an apparatus is not costly, complex, or expensive to maintain.

SUMMARY

An apparatus and method for operably mounting a slider onto a recloseable plastic zipper closure is provided that improves the prior art.

In one aspect, an apparatus for operably mounting a slider onto a recloseable plastic zipper closure includes a rotor having an outer periphery and at least one slider-engaging shoulder extending from the outer periphery. The outer periphery has a slot there along sized to accommodate a zipper closure therein. An insertion wedge is adjacent to a portion of the outer periphery of the rotor. The insertion wedge has a leading edge and a trailing edge and increases in thickness from the leading edge to the trailing edge. The insertion wedge is sized to slidably accommodate a slider for mounting onto a zipper closure. A zipper guide member is adjacent to the outer periphery of the rotor and is adjacent to the trailing edge of the insertion wedge constructed and arranged to guide and hold a zipper closure while a slider is mounted thereon. A guide finger is adjacent to the trailing edge of the insertion wedge and is constructed and arranged to prevent a slider from lifting away from a zipper closure as the rotor rotates.

In one embodiment, the apparatus further includes a pair of opposing walls on opposite sides of the rotor and an insertion pocket sized to hold a slider. The insertion pocket is defined by outer periphery of the rotor and the opposing walls.

The apparatus may further include a loading rack having an exit aperture oriented above and in communication with the insertion pocket. The loading rack is sized to hold one or more sliders before exiting by gravity through the exit aperture and into the insertion pocket.

The apparatus may further include a lower slider guide and an upper slider guide, each being adjacent to the trailing edge of the insertion wedge.

The apparatus may further include a motor driving the rotor.

In one or more embodiments, the rotor includes at least two slider-engaging shoulders and at least two sections. Each section has a variable curvature radius that increases continuously between a first radius and a maximum radius coinciding with one of the shoulders.

In example implementations, the rotor includes an inwardly extending curved relief area adjacent to each of the shoulders.

In some examples, the rotor is mounted to rotate in a plane vertically oriented relative to a ground surface.

The rotor may have, in some example embodiments, a rotor section between each of the slider-engaging shoulders; each of the rotor sections having a constant radius.

In some embodiments, the rotor is mounted to rotate in a plane horizontally oriented relative to a ground surface.

In some embodiments, the loading rack has a straight holding chute.

In some embodiments, the loading rack has a holding chute that is S-shaped.

In a further aspect, a method of operably mounting a slider onto a recloseable plastic zipper closure having interlocking tracks is provided. The method includes providing a plastic zipper closure with interlocking tracks, the tracks having top edges and bottom shoulders. The method also includes providing a slider having a top member and a pair of spaced legs depending from the top member. The legs have opposing hooks. The slider is constructed and arranged to release and interlock the interlocking tracks when operably mounted on the zipper closure, as the slider is moved relative to the zipper closure. The method further includes automatically moving the slider from an initial position toward the zipper closure along a curved path by using a rotating rotor having an outer periphery and at least one slider-engaging shoulder extending from the outer periphery and adjacent to a pocket accommodating the slider to push the slider from the initial position toward the zipper closure; while moving the slider, flexing apart the legs of the slider; while the legs are flexed apart, mounting the slider onto the zipper closure so that the legs straddle the tracks, and the top member is oriented on the top edges of the tracks; and allowing the legs to return to a pre-flexed position so that the hooks on the legs engage the bottom shoulders of the tracks.

In examples, the step of flexing apart the legs of the slider includes moving the slider along an insertion wedge having a leading edge and trailing edge, with the legs of the slider straddling the wedge, the wedge increasing in thickness from the leading to the trailing edge.

The step of automatically moving may include using a rotating rotor to push the slider from an initial position, along a curved path, to and along the insertion wedge, and then onto the zipper closure.

In one or more implementations, the step of mounting the slider includes moving the slider onto the zipper closure and under a guide finger to prevent the slider from moving upwardly away from the zipper closure.

In example implementations, the step of automatically moving the slider includes moving the slider along a curved path at least 90° from the initial position to the zipper closure.

The step of automatically moving the slider may include moving the slider along a curved path at least 150° from the initial position to the zipper closure.

In example embodiments, the step of providing a slider includes providing the slider from a loading rack.

In example implementations, the step of providing a slider includes allowing the slider to fall by gravity from the loading rack into the insertion pocket, the insertion pocket formed by an outer contour of a rotor and a pair of walls on opposite sides of the rotor.

The step of automatically moving may include pushing the slider with a shoulder on the rotor from the insertion pocket and through a curved path to the zipper closure.

The step of moving the slider along a curved path can include moving the slider along a plane vertically oriented relative to a ground surface.

The step of moving the slider along a curved path can include moving the slider along a plane horizontally oriented relative to a ground surface.

The step of providing the slider from a loading rack can include turning the slider from an upright position, with the top member oriented over the legs, to a side position by moving the slider along a holding chute in the loading rack The method can include the apparatus as variously characterized above.

A variety of examples of desirable features or methods are set forth in part in the description that follows, and in part will be apparent from the description, or maybe learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

A. Example Package and Closure

Figure 7:
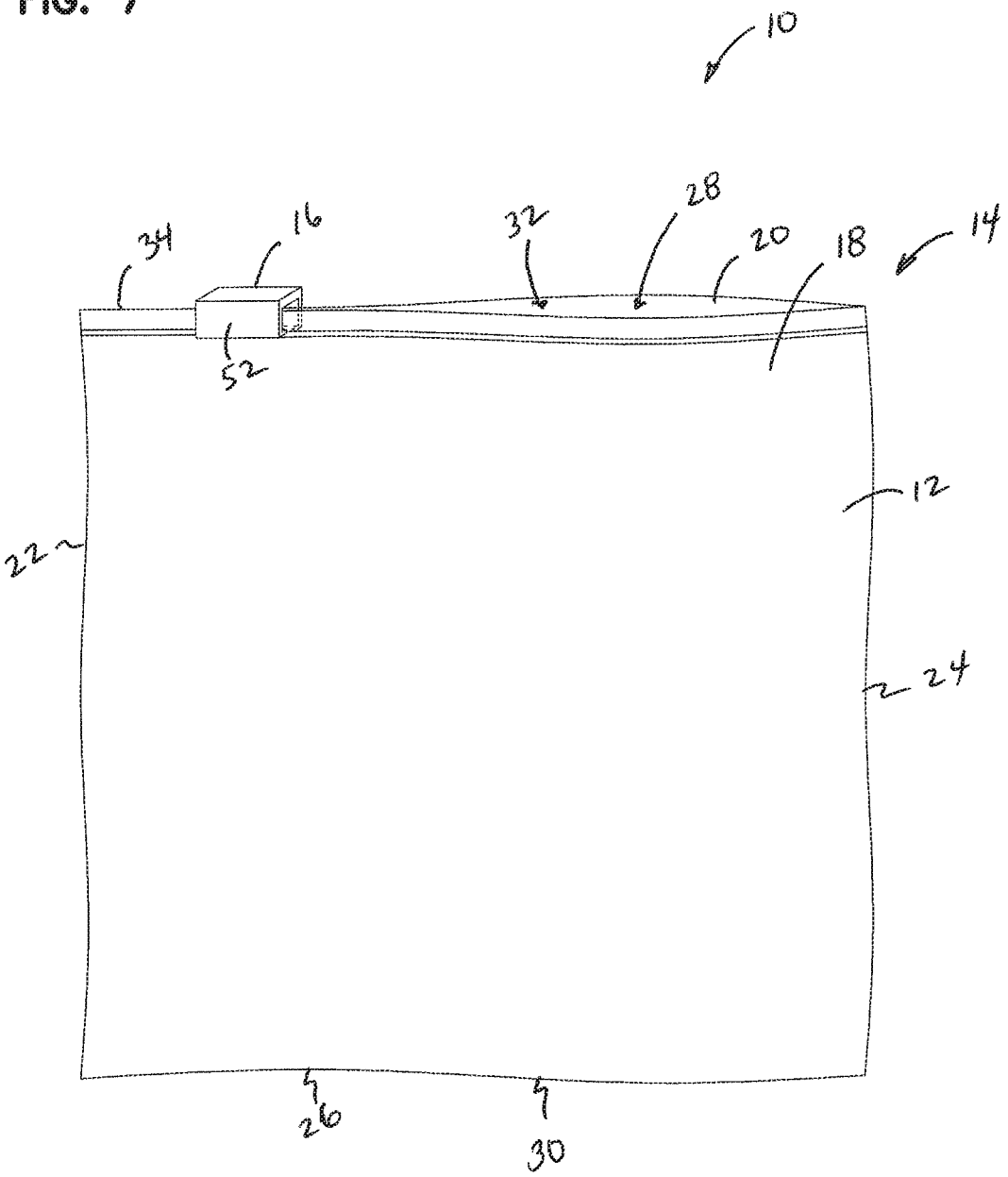
FIG. 7 is a schematic, perspective view of an example flexible, recloseable package with a slider, which can be used with the apparatus of FIGS. 1 and 8.

In FIG. 7 is one example embodiment of a packaging arrangement in the form of a recloseable, flexible package 10. For example, the package 10 is a polymeric package, such as a plastic bag 12 having a recloseable closure in a form of a plastic zipper closure 14. Also shown is a slider 16 for opening and closing the zipper closure 14.

The package 10 can be many different arrangements. In the example shown, the package 10 includes first and second opposed panel sections 18, 20, typically made from a flexible, polymeric, plastic film. With some manufacturing techniques, the first and second panel sections 18, 20 are heat sealed together along two side edges 22, 24 and meet at a fold line 26 in order to form a three-edged containment section for a product within an interior 28 of the package 10. In the embodiment shown, the fold line 26 comprises the bottom edge 30 of the package 10. Access is provided to the interior 28 of the package 10 through an open mouth 32 along a top edge 34 of the package 10. In this embodiment, the mouth 32 extends the width of the package 10 between the side edges 22, 24. The mouth 32, in this embodiment, is opposite of the bottom edge 30. In other embodiments, the panel sections 18, 20 can be heat sealed together along the side edges 22, 24 as well as the bottom edge 30. Many alternatives are possible.

The zipper closure 14 is illustrated in the FIG. 7 embodiment at the mouth 32 along the top edge 34. In other embodiments, the zipper closure 14 could be positioned on the package 10 at a location different from the mouth 32, depending upon the application needs of the package 10.

Figure 5:
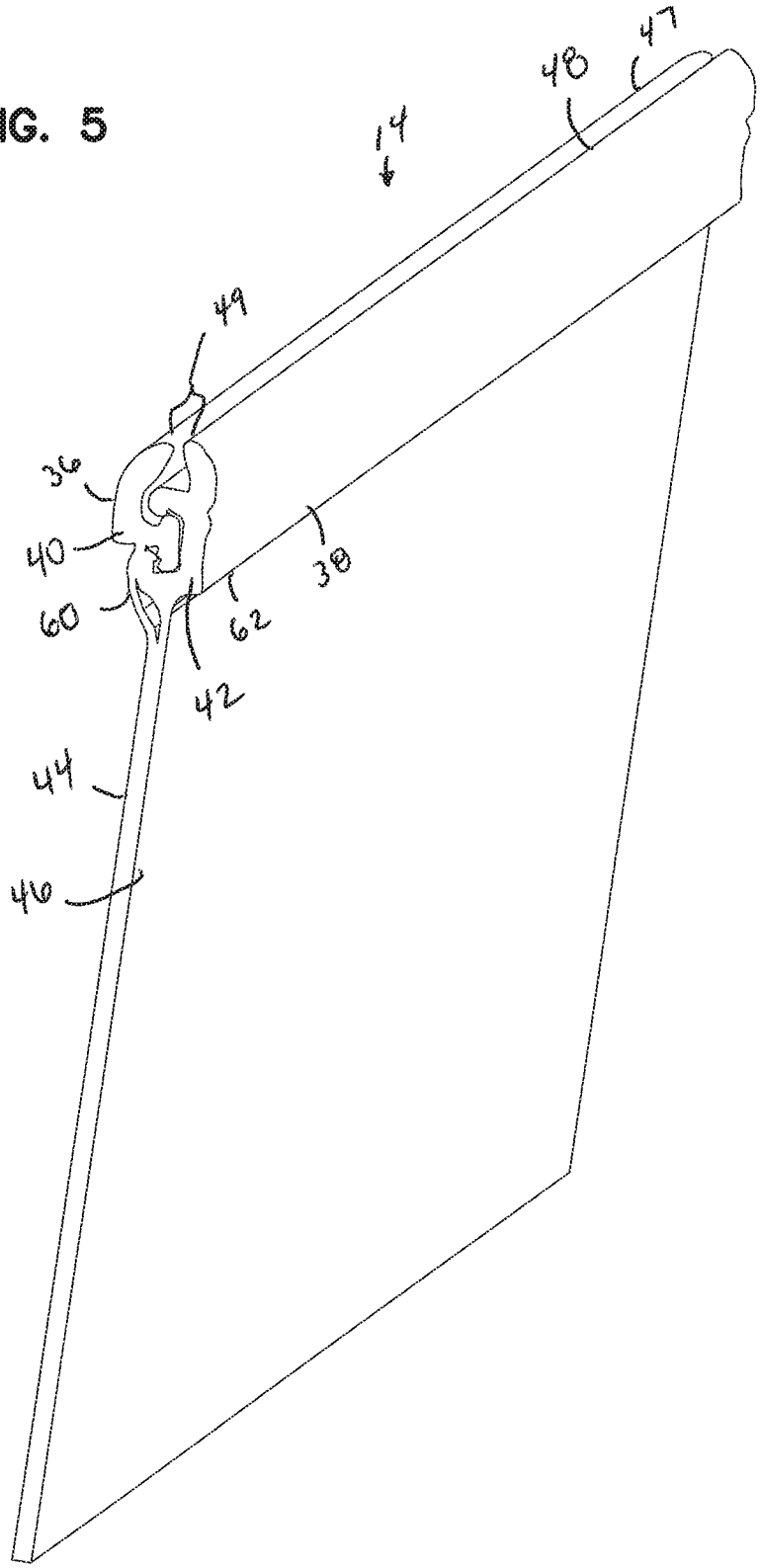
FIG. 5 is a schematic, perspective view of one type of recloseable plastic zipper closure that can be used with the apparatus of FIGS. 1 and 8.

The zipper closure 14 can be many different types of zipper closures. In this embodiment, and as illustrated in FIG. 5, the zipper closure 14 has oppositely extending interlocking tracks 36, 38. The tracks 36, 38 include releasably engaging opposite profiles 40, 42, as in known in the prior art. Usable example engageable profiles are described in further detail in U.S. Pat. No. 5,442,838, incorporated herein by reference. Each of the profiles 40, 42 has an attachment flange 44, 46 extending therefrom. The attachment flange is 44, 46 can be used to attach the profiles 40, 42 to the panel sections 18, 20 for use as part of the recloseable package 10. Many alternatives are possible.

The zipper closure 14 includes bottom shoulders 60, 62 between the closure profiles 40, 42 and the attachment flanges 44, 46. The shoulders 60, 62 can be used to help hold the slider 16 operably in place on the closure 14.

The tracks 36, 38 each has a top edge 47, 48 on an opposite end of the tracks 36, 38 from the shoulders 60, 62.

The zipper closure 14, in this embodiment, is solid and notchless. In other embodiments, the zipper closure includes a notch for serving as a parking place for a slider, as well as to facilitate mounting of the slider 16 onto the zipper closure. In embodiments of the zipper closure 14 that are notchless, to facilitate insertion of a separator finger (or plow) of the slider 16 between the tracks 36, 38, the zipper closure 14 can include a small gap 49 (FIG. 5) between the tracks 36 and 38. The gap 49 is provided during, for example, the fabrication process of the zipper closure 14. The gap 49 is sized to allow a separator finger of the slider 16 to be inserted therein.

B. Example Slider

Many different types of sliders can be used to engage and release the zipper closure 14 in order to open and close access to the interior 28 of the package 10. The slider 16 shown in FIG. 4 is one example used.

Figure 4:
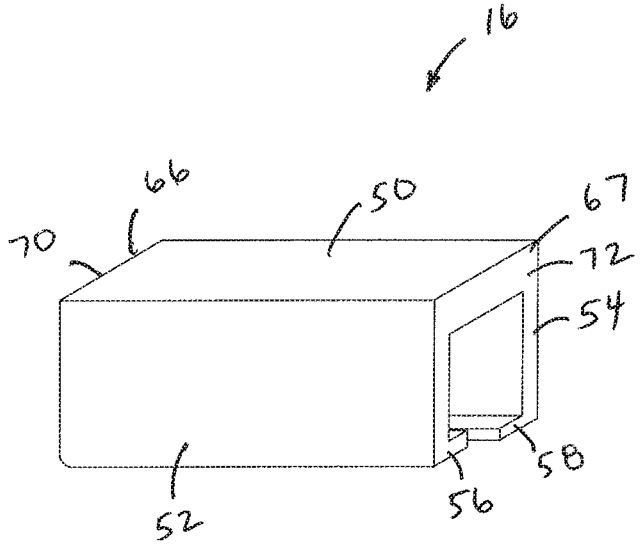
FIG. 4 is a schematic perspective view of a slider that can be used with the apparatus of FIGS. 1 and 8.

In reference now to FIG. 4, the slider 16 includes a top member 50 and a pair of legs 52, 54 spaced apart from each other and depending from the top member 50. The legs 52, 54 have opposing hooks 56, 58, which can be seen inwardly facing each other. The hooks 56, 58 are used to engage bottom shoulders 60, 62 (FIG. 5) of the tracks 36, 38. When the slider 16 is operably mounted on the zipper closure 14, the top member 50 glides along the top edges 47, 48 (FIG. 5) of the tracks 36, 38, while the legs 52, 54 straddle the tracks 36, 38, and the hooks 56, 58 engage the bottom shoulders 60, 62 of the tracks 36, 38.

The top member 50 may include a separator finger or plow (not shown), which can be used to release or disengage the interlocked profiles 40, 42.

In the embodiment of FIG. 4, the slider 16 has opposite ends 66, 67. The end 66 is a trailing edge 70, while the end 67 is a leading edge 72, when the slider 16 is being mounted onto the zipper closure 14 using the apparatus as disclosed herein and described further below.

The slider 16 can include ones such as those described in U.S. Pat. Nos. 6,376,035 and 6,293,701, each patent being incorporated herein by reference. In some arrangements, the slider 16 can include child-resistant features, such as the slider shown in U.S. Pat. No. 9,505,531, incorporated by reference herein.

C. Example Apparatus for Mounting the Slider onto the Zipper Closure

Figure 1:
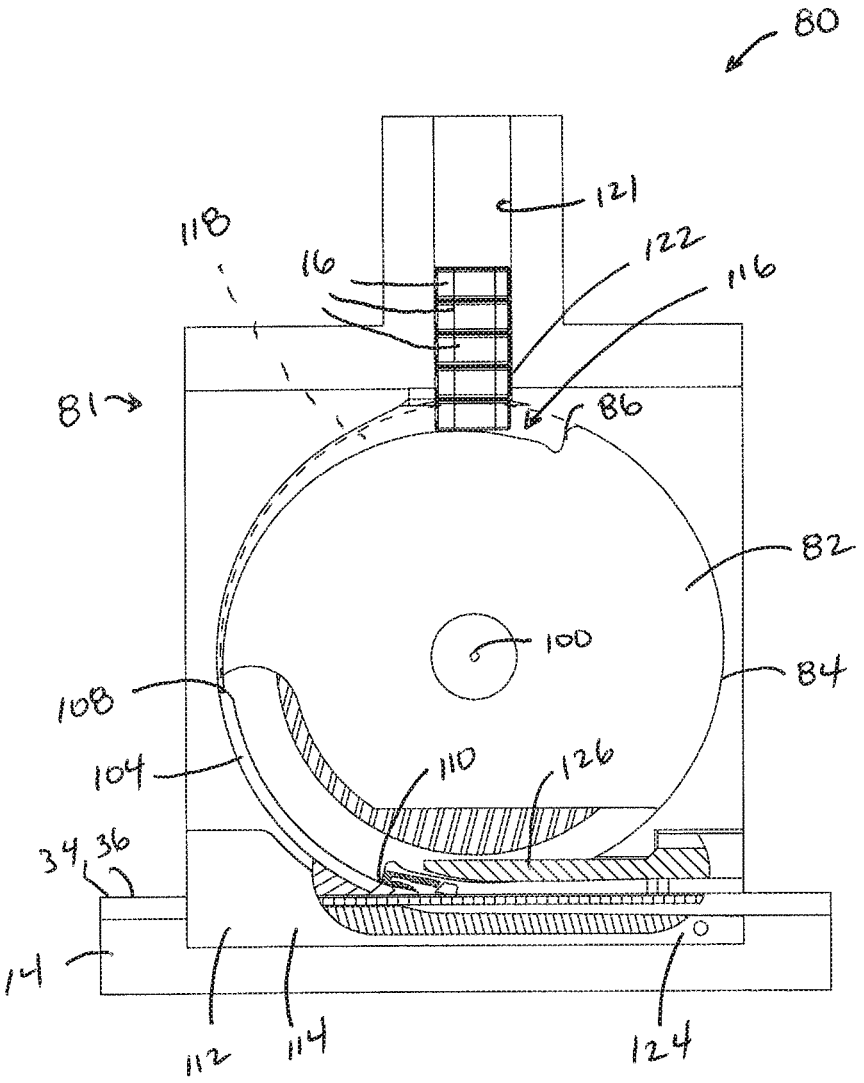
FIG. 1 is a schematic front and partial cross-sectional view of one embodiment of a slider insertion apparatus, constructed in accordance with principles of this disclosure.
Figure 2:
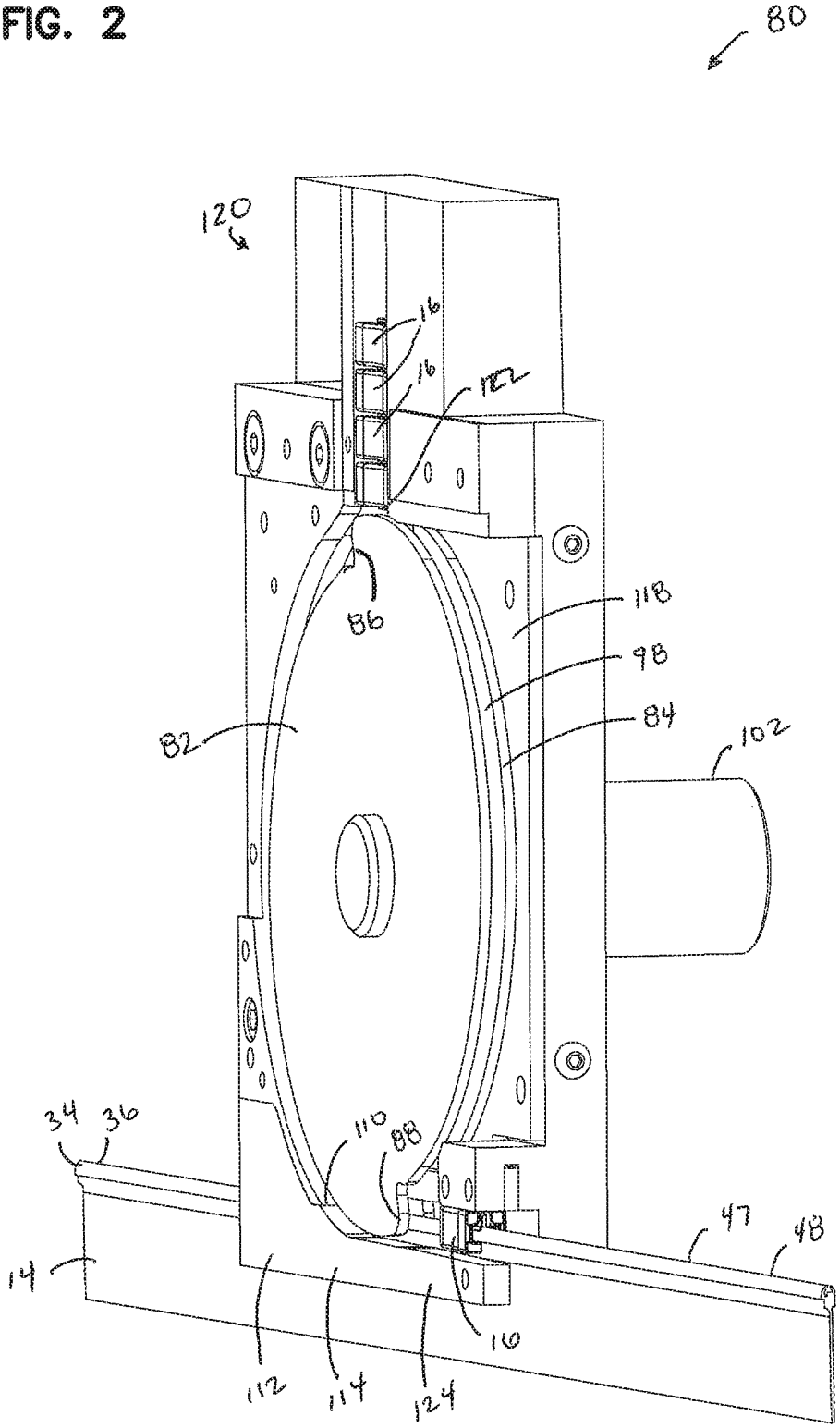
FIG. 2 is a schematic, perspective view of the apparatus of FIG. 1.

FIGS. 1 and 2 illustrate an example embodiment of an apparatus 80 for operably mounting the slider 16 onto the recloseable zipper closure 14.

The apparatus 80 includes a slider insertion device 81 having a rotor 82. The rotor 82 is used to push the slider 16 from an initial position, along a path, and eventually onto the zipper closure 14. The path, in this embodiment, includes a curved path. While alternatives are possible, typically the curved path will be at least 90° from the initial position to the zipper closure 14. In many example embodiments, the curved path will be at least 150° and sometimes at least 180° from the initial position to the zipper closure 14.

Figure 3:
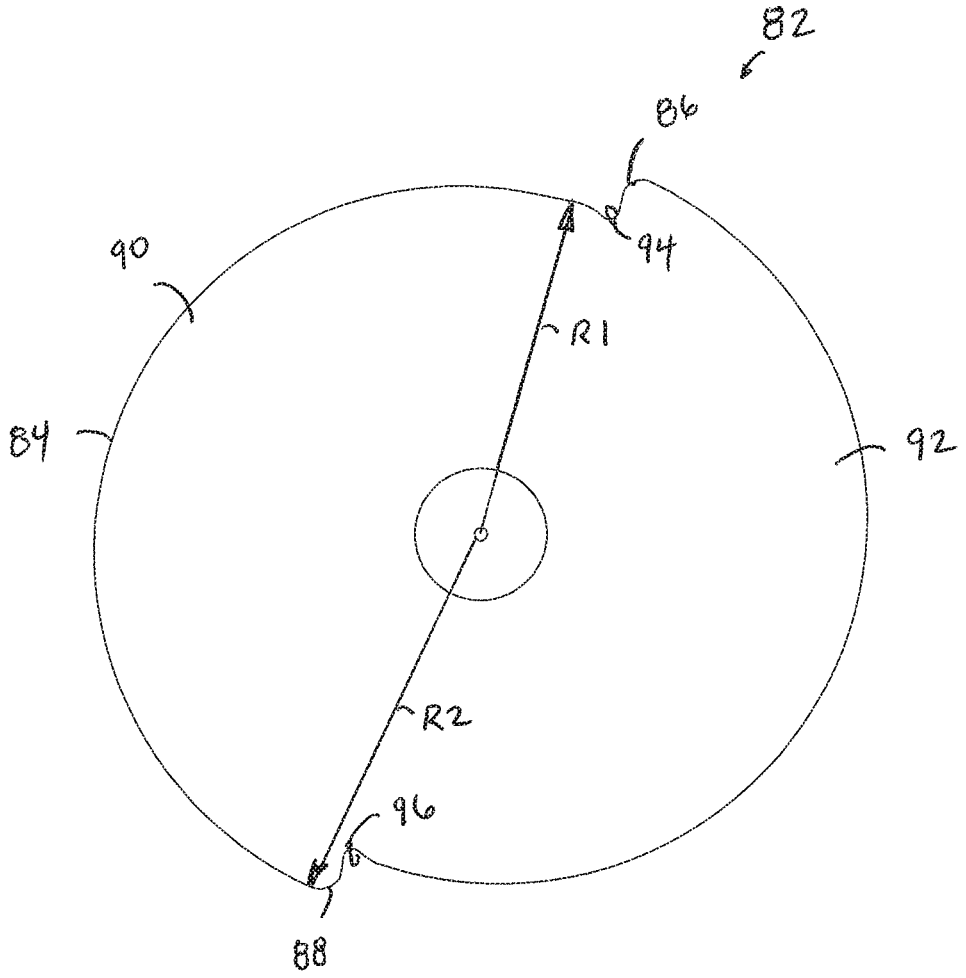
FIG. 3 is a schematic front view of a rotor used in the apparatus of FIG. 1.

FIG. 3 illustrates a front view of an example embodiment of the rotor 82 usable in the apparatus 80. The rotor 82 has an outer periphery 84. There is at least one slider-engaging shoulder 86 extending the outer periphery 84. Preferably, an as shown in this embodiment, there are two slider-engaging shoulders at 86, 88. In other embodiments, there could be additional slider engaging shoulders 86 extending from the outer periphery 84.

Still in reference to FIG. 3, in this embodiment having two slider engaging shoulders 86, 88, the rotor 82 includes at least two sections 90, 92. Each section 90, 92 has a variable curvature radius that increases continuously between a first radius, shown at R1 and a maximum radius R2. The maximum radius R2 coincides with one of the shoulders 86, 88. In embodiments that have more than two sliding engaging shoulders, there will be more than to sections of variable curvature radii. As will be understood from further description below, the sections 90, 92 are shaped in a way to allow the slider 16 to drop by force of gravity from a loading rack into an insertion pocket gradually without additional manipulation from other mechanisms and ensure that the slider 16 lands into the insertion pocket, even if the rotor 82 is rotating continuously and/or at a high rate.

Still in reference to FIG. 3, adjacent to each of the shoulders 86, 88 is a curved relief area 94, 96. The relief areas 94, 96 accommodates the slider 16 as it is guided towards mounting on the zipper closure 14.

In reference now to FIG. 2, the rotor 82 has a continuous circumferential and radially inwardly directed slot 98 along the outer periphery 84. The slot 98 is sized to accommodate the zipper closure 14 therein. That is, the width across the zipper closure 14 fits within the slot 98 so that the rotor 82 straddles the zipper closure 14 without contacting the zipper closure 14 during the slider mounting process. As will be understood further below, the slot 98 allows the rotor 82 to pass over the top edges 47, 48 of the zipper closure 14 and leave the slider 16 straddling the zipper closure 14 at a desired position along the zipper closure 14.

The rotor 82 is mounted as part of the slider insertion device 81 to rotate about a center axis 100 (FIG. 1). The rotor 82 can be driven by a variety of power mechanisms, including a motor 102 (FIG. 2). Many embodiments are possible. In a preferred implementation, the motor 102 is controlled with a programmable logic controller (PLC). The motor 102 can be any type of motor that is controllable by a PLC, such as a servo or step motor. The PLC will control the rotation of the motor 102 to achieve the desired spacing between the sliders 16 in harmony with the motion of the zipper closure 14. The slider 16 can be applied to the zipper closure 14 while the zipper closure 14 is stationary during an intermittent cycle, or continuously depending on the desired process conditions.

The rotor 82 is free of additional moving parts, such as springs, cams, or radially expanding posts. This "moving-part free" design of the rotor 82 leads to advantages. For example, moving parts are subject to variations in position and alignment that require setup, that can move over time and affect performance. Moving parts are also subject to wear. Rotor 82 is not subject to these problems.

In accordance with principles of the disclosure, the apparatus 80 further includes an insertion wedge 104. The insertion wedge 104 helps to move the slider 16 from an unmounted position to a position which the slider 16 is operably mounted onto the zipper closure 14.

Figure 6:
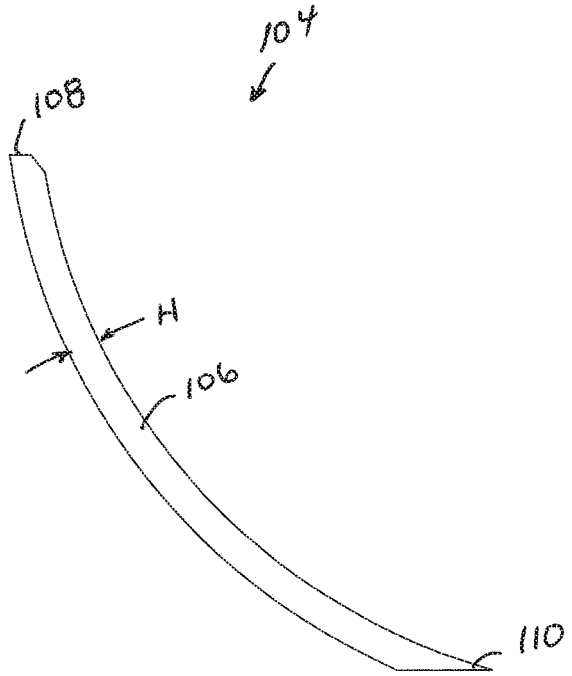
FIG. 6 is a schematic, front view of an insertion wedge used in the apparatus of FIG. 1.

FIG. 6 illustrates a front view of one example embodiment of the insertion wedge 104. The insertion wedge 104 includes a curved member 106 having a leading edge 108 and a opposite trailing edge 110. The curved member 106 increases in thickness from the leading edge 108 to the trailing edge 110. In one preferred embodiment, the leading edge 108 has a thickness or width that is the same or less than a distance between the opposing legs 52, 54 (FIG. 4) of the slider 16. The trailing edge 110 has a width or thickness that is equal to or greater than the width or thickness of the matted interlocking profiles 40, 42 (FIG. 5). The height H (FIG. 6) of the insertion wedge 104 is dimensioned for a given slider and zipper type and for a given rotor and guide geometry.

The insertion wedge 104 is located adjacent to a portion of the outer periphery 84 of the rotor 82. In this manner, the rotor 82 can push the slider 16 with one of the shoulders 86, 88 onto the leading edge 108 of the insertion wedge 104. The insertion wedge 104 is sized to slidably accommodate the slider 16 so that the legs 52, 54 will straddle the opposite sides of the wedge 104, slide along the wedge 104 from the leading edge 108 and to the trailing edge 110. While the slider 16 is being pushed by one of the shoulders 86, 88 along the wedge 104, the legs 52, 54 will be flexed apart due to the increasing thickness of the wedge 104. While the legs 52, 54 are flexed apart, the slider 16 is pushed off of the wedge 104 from the trailing edge 110 and onto the zipper closure 14, as will be explained further below.

In accordance with principles of this disclosure, the apparatus 80 further includes a zipper guide member 112.

The zipper guide member 112 is constructed and arranged to guide and hold the zipper closure 14 while the slider 16 is mounted thereon. In the embodiment shown, the zipper guide member 112 is adjacent to the outer periphery 84 of the rotor 82 and adjacent to the trailing edge 110 of the insertion wedge 104. The zipper guide member 112, in this embodiment, includes a block 114 with a slot in which the zipper closure 14 extends through. The shape of the slot will be determined by the shape of the zipper closure 14 and is dimensioned such that the zipper closure 14 can be pulled through the slot of the guide member 112 without excessive drag and without excessive play that might result in misalignment between the slider 16 and the zipper closure 14 during insertion. Many embodiments for the guide member 112 are possible.

In accordance with principles of this disclosure, the apparatus 80 further includes an insertion pocket 116. The insertion pocket 116 is sized to hold the slider 16. The insertion pocket 116 is defined by the outer periphery 84 of the rotor 82 and a pair of opposing walls, one of which being shown at 118 on opposite sides of the rotor 82. The wall 118 illustrated is a back or rear wall, while the front wall is omitted for sake of clarity.

The apparatus 80 can have several insertion pockets 116. In the example shown, there are two insertion pockets 116, with each of the insertion pockets 116 being adjacent to one of the shoulders 86, 88.

In accordance with principles of this disclosure, the apparatus 80 further includes a loading rack 120. The loading rack 120 includes an exit aperture 122 that is oriented in communication and vertically above the insertion pocket 116. The loading rack 120 is sized to hold one or more sliders 16 in a holding chute 121 before exiting by gravity through the exit aperture 122 and into the insertion pocket 116. In this embodiment, the holding chute 121 is straight with a central longitudinal axis generally perpendicular to a horizontal ground surface. Other embodiments may include other shapes and orientations relative to the ground surface. In preferred implementations, the sliders 16 are loaded upside down in the loading rack 120, such that the legs 52, 54 are over the top member 50. The loading rack 120 can be many types of systems, and in the example embodiment, is a magazine-type rack that receives the sliders 16 from a sorting device (not shown) and continuously supplies the sliders 16 to the insertion pocket 116. The loading rack 120 acts as an accumulator or buffer for the sliders 16 to account for variations in output between the sorting device and the rotor 82. In this embodiment, when the slider 16 drops by gravity from the loading rack 120 into the insertion pocket 116, the slider 16 will be loaded into the insertion pocket 116 so that it is resting on its top member 50 with its legs 52, 54 facing radially outwardly from the rotor 82.

The apparatus 80 further includes a first slider guide 124 and a second slider guide (or guide finger) 126, each being adjacent to the trailing edge 110 of the insertion wedge 104. In the embodiment of FIG. 1, the first slider guide 124 is also a lower slider guide, while the second slider guide 126 is also an upper slider guide or guide finger. The first slider guide 124 can be part of the outer wall and extend adjacent to (and, in this embodiment, under) the insertion wedge 104 and then continue under the interlocked profiles 40, 42 of the zipper closure 14, such that at any point during insertion, the slider 16 is guided and does not rely on the profiles 40, 42 of the zipper closure 14 for manipulation of the slider 16.

The second slider guide (or guide finger) 126 illustrated in FIG. 1 as an upper slider guide or guide finger, generally can run parallel to the first slider guide 124 and the zipper closure 14. In the FIG. 1 embodiment, the second slider guide 126 is over the zipper closure 14. The second slider guide 126 prevents the slider 16 from lifting up on or away from the zipper closure 14 during the insertion process as the insertion pocket 116 rotates up and away during the cycle.

In the embodiment of FIGS. 1-3, the slider insertion device 81 is generally a vertical system in that the rotor 82 rotates within a plane that is vertically oriented relative to a ground surface (e.g., the floor), when the ground is generally horizontal. In this embodiment, the plane or rotation of the rotor 82 is also generally parallel to the direction that the sliders 16 drop by gravity from the loading rack 120. This system is in contrast with the system of FIGS. 8-10, which is a horizontal system, described below.

D. Horizontally Oriented Apparatus, FIGS. 8-10 and FIG. 11

FIGS. 8-10 and 11 are illustrations of additional embodiments of an apparatus 180 for mounting a slider onto a recloseable plastic zipper closure. The apparatus 180 is analogous to the apparatus 80, except that the slider insertion device 181 is horizontally oriented, rather than vertically oriented as the insertion device 81 is. The apparatus 180 has many of the same parts, which carry the same reference numerals. The description of those parts is not repeated here, but those description are incorporated herein by reference. The differences between the horizontal slider insertion device 181 and the vertical slider insertion device 81 are discussed here below and have different reference numerals.

Figure 8:
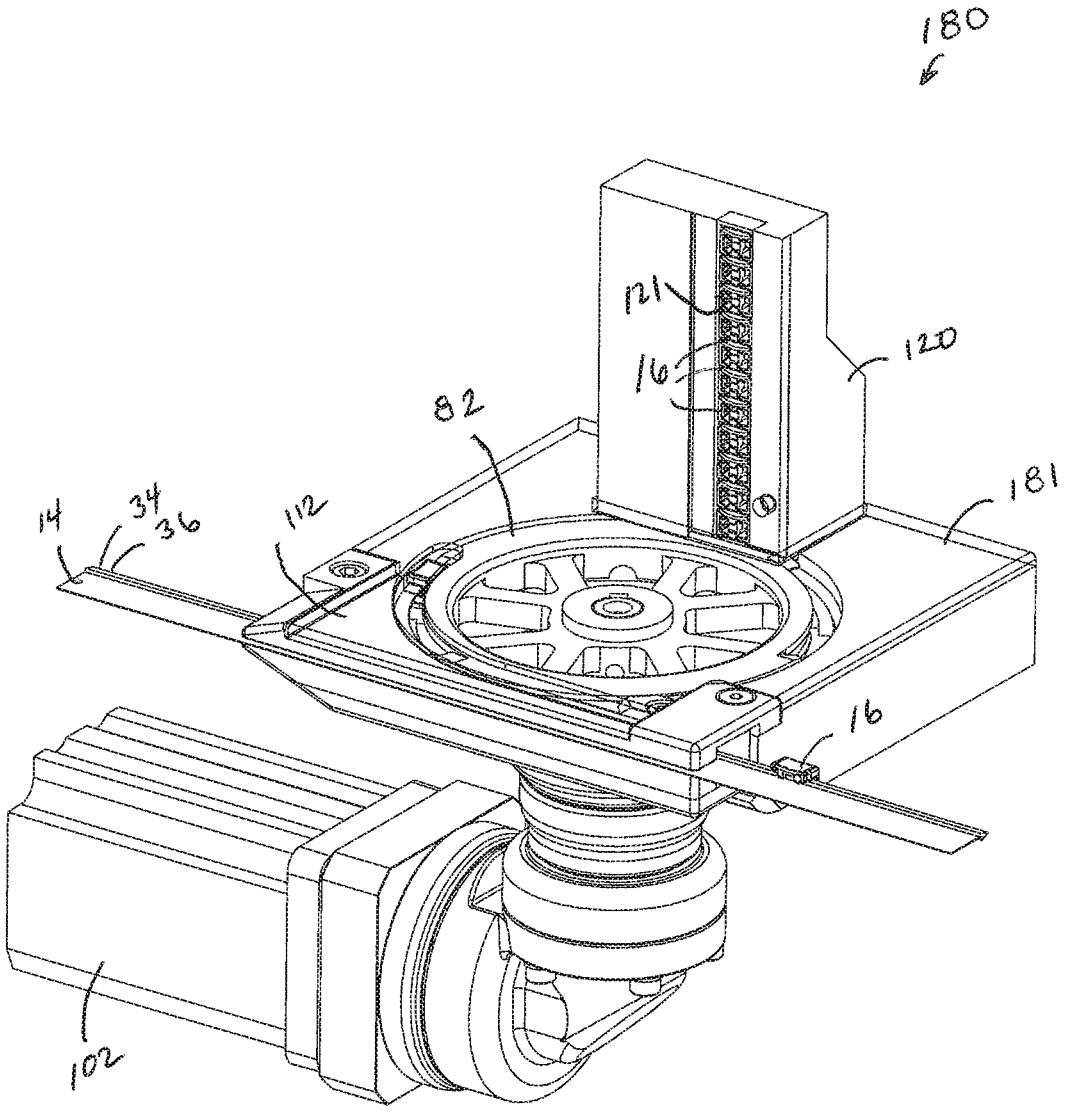
FIG. 8 is a schematic, perspective view of another embodiment of a slider insertion apparatus, constructed in accordance with principles of this disclosure.
Figure 9:
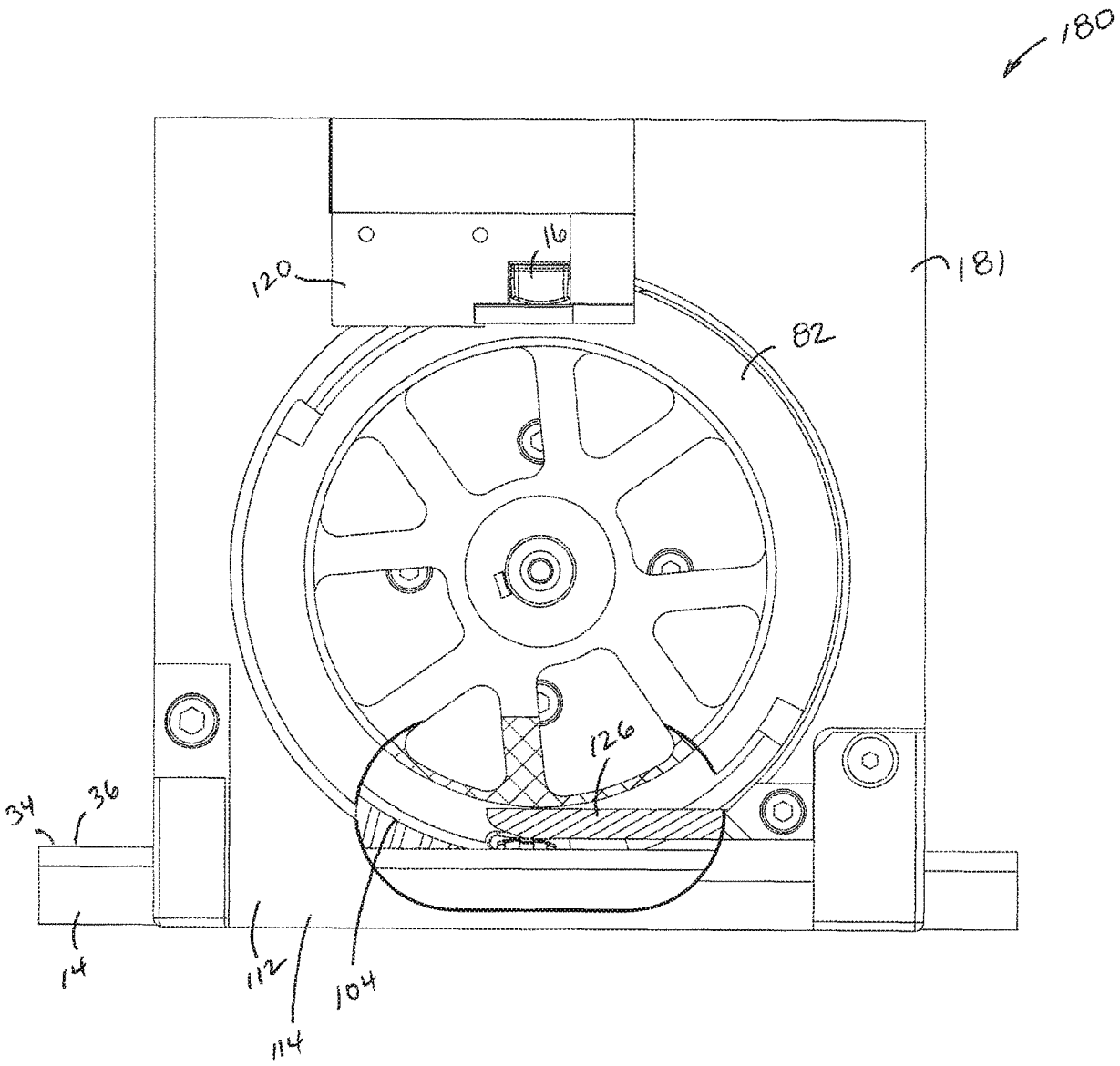
FIG. 9 is a top and partial cross-sectional view of the apparatus of FIG. 8.

In the FIG. 8 embodiment, the rotor 82 is mounted to rotate in a plane horizontally oriented relative to the ground surface. The horizontal plane is generally perpendicular to the direction that the sliders 16 drop by gravity from the loading rack 120.

Figure 10:
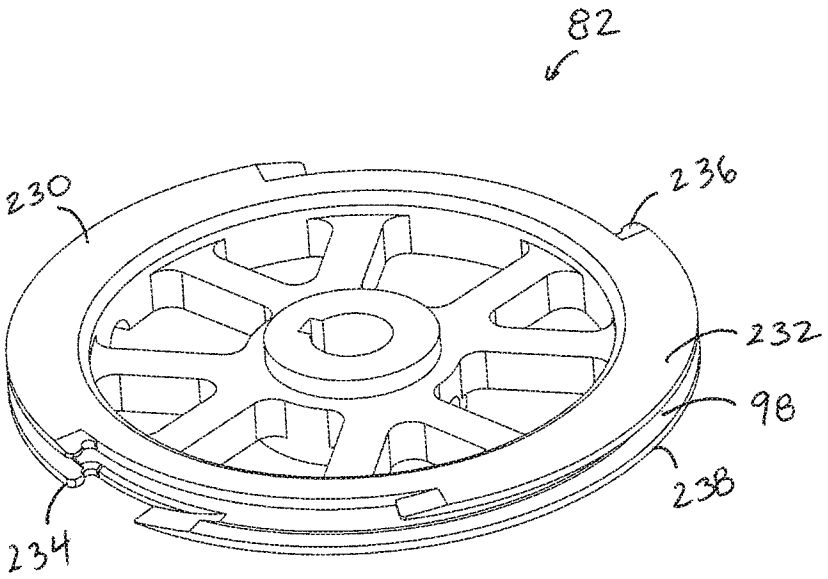
FIG. 10 is a perspective view of a rotor used in the apparatus of FIG. 8.

In FIG. 10 is a perspective view of the rotor 82 used with the apparatus 180 of FIGS. 7 and 8. In this embodiment, the rotor 82 includes two rotor sections 230, 232 between the slider engaging shoulders 234, 236. Each of the sections 230, 232 has a constant and equal radius along the outer periphery 238 between the shoulders 232, 234. In other embodiments, there can be more or fewer slider engaging shoulders 234, 236.

Figure 11:
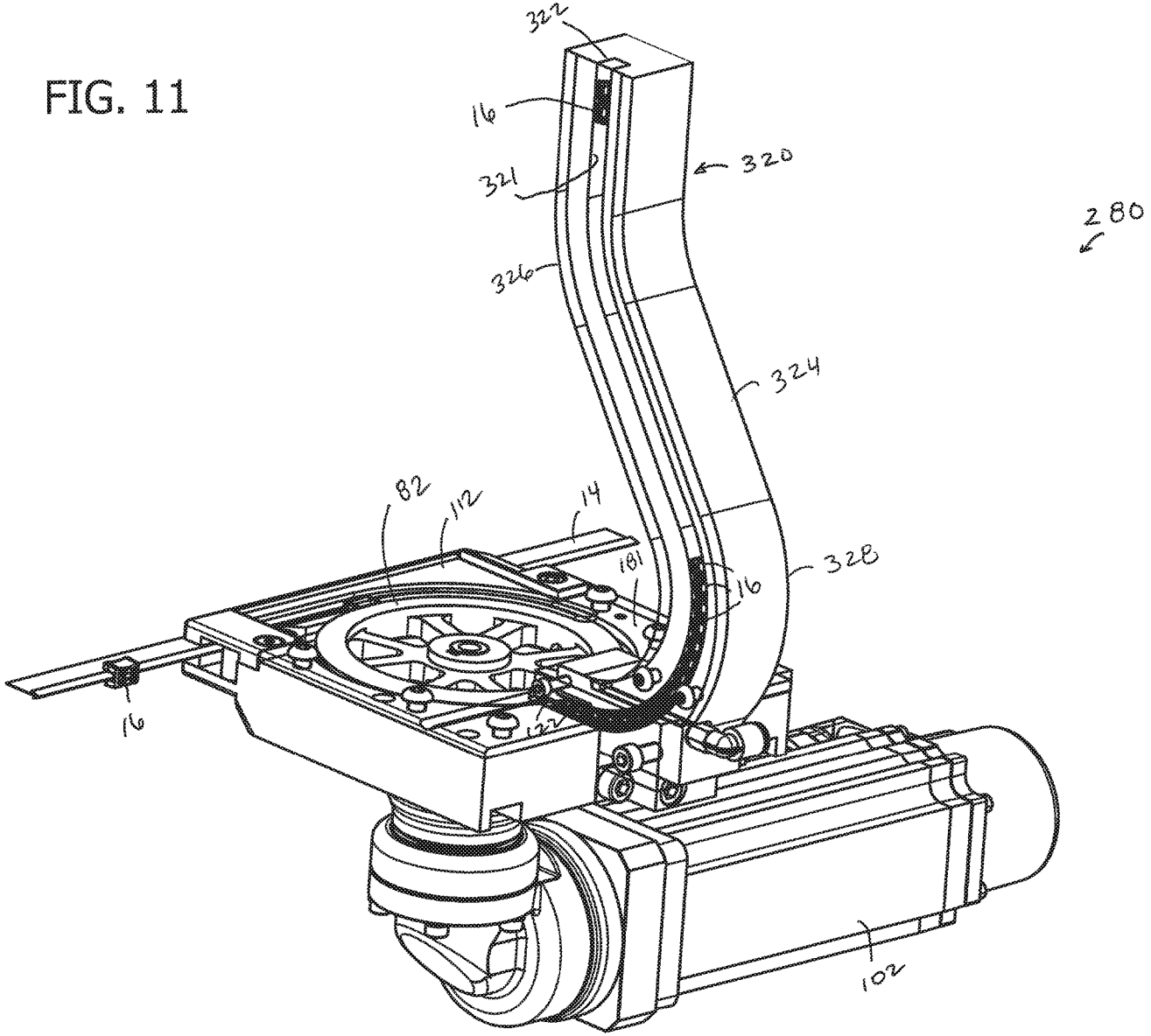
FIG. 11 is a perspective view of another embodiment of a slider insertion apparatus, constructed in accordance with principles of this disclosure.

The embodiment of FIG. 11 is similar to the FIG. 8 embodiment, in that apparatus 280 has the rotor 82 mounted to rotate in a plane horizontal relative to the ground surface. The apparatus 280 has many of the same parts as the embodiment of FIGS. 1-7, which carry the same reference numerals and whose description is not again repeated here but incorporated herein by reference.

The difference between the embodiment of FIG. 8 and the embodiment of FIG. 11 is in the loading rack 320. The loading rack 320 is shaped to turn the sliders 16 from an "upright" position to a "side" position. By "upright" position, it is meant that the sliders 16 are oriented with the top member 50 oriented at the top most of the slider 15 and generally in a plane horizontal relative to the ground surface and above the legs 52, 54. By "side" position, it is meant that the sliders 16 are oriented with the legs 52, 54 generally in planes horizontal relative to the ground surface and with the top member 50 extending between them and in a plane generally perpendicular to the ground surface; the top member 50 is also spaced farther from the rotor 82 than the free ends or hooks 56, 58 of the legs 52, 54. The shape of the loading rack 320 can have many variations, and in the particular example illustrated, the loading rack 320 has a holding chute 321 in a modified S-shape as it extends from a slider loading end 322, along a section 324 having a first radiused curve 326 and a second opposite radiused curve 328, until the exit aperture 122.

E. Example Methods

The principles and devices described above can be used to practice a method of operably mounting a slider onto a recloseable plastic zipper closure having interlocking tracks.

The method includes providing a solid, notchless, recloseable plastic zipper closure with interlocking tracks, in which the tracks have top edges and bottom shoulders. For example, the zipper closure 14 shown in FIG. 5 can be provided. The zipper closure 14 includes the interlocking tracks 36, 38, having top edges 47, 48 and bottom shoulders 60, 62. By the term "notchless", it is meant that the tracks 36, 38 are solid and continuous without interruptions and without cutouts or notches that are sometimes used in prior art zipper closures as parking places for sliders.

The method also includes providing a slider having a top member and a pair of spaced legs depending from the top member, in which the legs have opposing hooks. For example, the slider 16 as shown in FIG. 4 can be used. The slider 16 has top member 50 and a pair of spaced legs 52, 54 depending from the top member 50. The legs 52, 54 have opposing hooks 56, 58. The slider 16 is constructed and arranged to release and interlock the interlocking tracks 36, 38, when operably mounted on the zipper closure 14 as the slider 16 is moved relative to the zipper closure 14.

In example methods, the step of providing a slider 16 includes providing the slider 16 from a loading rack. For example, the magazine style loading rack 120 can be used. The slider 16 is oriented in the loading rack 120 stacked on top of each other, in which each slider 16 is resting on its top member 50 with the legs 52, 54 extending upwardly from the top member 50.

In methods in which the loading rack 120 is used, the step of providing the slider 16 can include allowing the slider 16 to fall by gravity from the loading rack 120 and into an insertion pocket. For example, the slider 16 can drop by gravity from the loading rack 120 into insertion pocket 116 which is formed by the outer contour or periphery 84 of the rotor 82 and a pair of walls 118 on opposite sides of the rotor 82.

The method includes automatically moving the slider 16 from an initial position toward the zipper closure 14. For example, the slider 16 can be automatically moved from the initial position along a curved path. The curved path can be at least 90° from the initial position to the zipper closure 14. In some methods, the slider 16 is moved along the curved path at least 150 degrees, or at least 180°, from the initial position to the zipper closure 14.

Preferably, the step of automatically moving the slider along the curved path includes moving the slider 16 along a plane vertically oriented relative to a ground surface. For example, in the embodiment of FIGS. 1-3, the slider 16 is moved through the curved path within a plane that is vertically oriented relative to the ground surface.

Alternatively, the step of moving the slider along a curved path can include moving the slider 16 along a plane horizontally relative to a ground surface. For example, in the embodiments of FIGS. 8-10, the slider 16 is moved along a curved path within a plane that is horizontal relative to the ground surface.

In preferred implementations, the step of automatically moving the slider 16 includes using a rotating rotor to push the slider 16 from the initial position, along the curved path, to and along the insertion wedge 104 and then onto the zipper closure 14. For example, the rotating rotor 82 can be used to push the slider 16 from the initial position, along the curved path, along the insertion wedge 104, and then onto the zipper closure 14.

Preferably, the step of automatically moving the slider 16 includes pushing the slider 16 with a shoulder on the rotor 82. For example, the rotor 82 can include slider engaging shoulders 86, 88 or slider engaging shoulders 234, 236. One of the shoulders 86, 88 or 234, 236 can push the slider 16 from the insertion pocket 116 and through the curved path to the zipper closure 14.

The method further includes, while moving the slider 16, flexing apart the legs 52, 54 of the slider 16. In example implementations, the step of flexing apart the legs 52, 54 of the slider 16 includes moving the slider 16 along an insertion wedge with the legs of the slider straddling the wedge. For example, the wedge 104 can be used. The slider 16 is moved along the wedge 104 by initially mounting the slider 16 at the leading edge 108 and the legs 52, 54 straddling the wedge 104. The slider 16 is slid along the wedge 104, which increases in thickness from the leading edge 108 until the trailing edge 110.

In accordance with principles of this disclosure, the method further includes, while the legs 52, 54 are flexed apart, mounting the slider 16 onto the zipper closure 15 so that the legs 52, 54 straddle the tracks 36, 38 and the top member 50 is oriented on the top edges 47, 48 of the tracks 36, 38.

In accordance with principles of this disclosure, the method includes allowing the legs, 52, 54 to return to a pre-flexed position so that the hooks 56, 58 on the legs 52, 54 engage the bottom shoulders 60, 62 of the tracks 36, 38. That is, after the slider 16 reaches the trailing edge 110 of the insertion wedge 104, it is moved onto the zipper closure 14, and the legs 52, 54 snap back to their original pre-flexed position to mount the slider 16 onto the zipper closure 14 and be positioned so that the slider 16 can function to interlock and release the profiles 40, 42.

Preferably, the step of mounting the slider 16 includes moving the slider 16 onto the zipper closure 14 under a guide finger to prevent the slider 16 from moving upwardly away from the zipper closure 14. For example, the upper or second slider guide 126 can function as a guide finger, which will prevent the slider 16 from moving away from a remaining portion of the zipper closure 14.

It should be appreciated that the apparatus 80, 180 provides a slider insertion device 81, 181 that is easy to operate in both intermittent and continuous modes. The apparatus 80, 180 does not require costly maintenance to remain in operation. Sliders can be applied to any position on the zipper closure without the need for additional mechanisms by changing the servo timing, speed, and/or position, whether the zipper is moving continuously or intermittently. Sliders can be applied to the zipper closure without cutting or notching the zipper closure. The zipper closure and slider are fully and independently guided/constrained throughout the insertion process. The apparatus 80, 180 does not rely on zipper and slider interference for alignment.

The above represents example principles. Many embodiments can be made utilizing these principles.

What is claimed is:

1. A method of mounting a slider onto a recloseable plastic zipper closure having interlocking tracks, the method comprising:

(a) providing a recloseable plastic zipper closure with interlocking tracks, the tracks having top edges and bottom shoulders;

(b) providing a slider having a top member and a pair of spaced legs depending from the top member; the legs having opposing hooks; the slider being constructed and arranged to release and interlock the interlocking tracks as the slider is moved relative to the zipper closure;

(c) moving the slider from an initial position toward the zipper closure at least 150° along a curved path by using a rotor having an outer periphery and at least one slider-engaging shoulder extending from the outer periphery and adjacent to a pocket accommodating the slider to push the slider from the initial position toward the zipper closure, wherein the rotor is free of springs, cams or radially extending posts;

(d) while moving the slider, flexing apart the legs of the slider;

(e) while the legs are flexed apart, mounting the slider onto the zipper closure so that the legs straddle the tracks and the top member is oriented on the top edges of the tracks; and (f) allowing the legs to return to a pre-flexed position so that the hooks on the legs engage the bottom shoulders of the tracks.

2. The method of claim 1 wherein the step of flexing apart the legs of the slider includes moving the slider along an insertion wedge having a leading edge and trailing edge, with the legs of the slider straddling the wedge, the wedge increasing in thickness from the leading edge to the trailing edge.

3. The method of claim 2 wherein the step of moving the slider includes using the rotor to push the slider from the initial position, along a curved path, to and along the insertion wedge, and then onto the zipper closure.

4. The method of claim 1 wherein the step of providing a slider includes providing the slider from a loading rack.

5. The method of claim 4 wherein the step of providing a slider includes allowing the slider to fall by gravity from the loading rack into the insertion pocket of the rotor, the insertion pocket formed by an outer contour of a rotor and a pair of walls on opposite sides of the rotor.

6. The method of claim 4 wherein the step of providing the slider from a loading rack includes turning the slider from an upright position, with the top member oriented over the legs, to a side position by moving the slider along a holding chute in the loading rack.

7. The method of claim 1 wherein the step of mounting the slider includes moving the slider onto the zipper closure and under a guide finger to prevent the slider from moving upwardly away from the zipper closure.

8. The method of claim 1 wherein the step of moving the slider along a curved path includes moving the slider along a plane vertically oriented relative to a ground surface.

9. The method of claim 1 wherein the step of moving the slider along a curved path includes moving the slider along a plane horizontally oriented relative to a ground surface.

10. A method of mounting a slider onto a notchless recloseable plastic zipper closure having interlocking tracks, the method comprising:

(a) providing a notchless recloseable plastic zipper closure with interlocking tracks, the tracks having top edges and bottom shoulders;

(b) providing a slider having a top member and a pair of spaced legs depending from the top member; the legs having opposing hooks; the slider being constructed and arranged to release and interlock the interlocking tracks, as the slider is moved relative to the zipper closure;

(c) moving the slider from an initial position toward the zipper closure at least 150° along a curved path by using a rotor having an outer periphery and at least one slider-engaging shoulder extending from the outer periphery and adjacent to a pocket accommodating the slider to push the slider from the initial position toward the zipper closure;

(d) while moving the slider, flexing apart the legs of the slider;

(e) while the legs are flexed apart, mounting the slider onto the zipper closure so that the legs straddle the tracks and the top member is oriented on the top edges of the tracks; and (f) allowing the legs to return to a pre-flexed position so that the hooks on the legs engage the bottom shoulders of the tracks.

11. The method of claim 10 wherein the step of flexing apart the legs of the slider includes moving the slider along an insertion wedge having a leading edge and trailing edge, with the legs of the slider straddling the wedge, the wedge increasing in thickness from the leading edge to the trailing edge.

12. The method of claim 11 wherein the step of moving the slider includes using the rotor to push the slider from the initial position, along a curved path, to and along the insertion wedge, and then onto the zipper closure.

13. The method of claim 10 wherein the step of providing a slider includes providing the slider from a loading rack.

14. The method of claim 13 wherein the step of providing a slider includes allowing the slider to fall by gravity from the loading rack into the insertion pocket of the rotor, the insertion pocket formed by an outer contour of a rotor and a pair of walls on opposite sides of the rotor.

15. The method of claim 13 wherein the step of providing the slider from a loading rack includes turning the slider from an upright position, with the top member oriented over the legs, to a side position by moving the slider along a holding chute in the loading rack.

16. The method of claim 10 wherein the step of mounting the slider includes moving the slider onto the zipper closure and under a guide finger to prevent the slider from moving upwardly away from the zipper closure.

17. The method of claim 10 wherein the step of moving the slider along a curved path includes moving the slider along a plane vertically oriented relative to a ground surface.

18. The method of claim 10 wherein the step of moving the slider along a curved path includes moving the slider along a plane horizontally oriented relative to a ground surface.

19. A method of mounting a slider onto a recloseable plastic zipper closure having interlocking tracks, the method comprising:

(a) providing a recloseable plastic zipper closure with interlocking tracks, the tracks having top edges and bottom shoulders;

(b) providing a slider from a loading rack; the slider having a top member and a pair of spaced legs depending from the top member; the legs having opposing hooks;

the slider being constructed and arranged to release and interlock the interlocking tracks, as the slider is moved relative to the zipper closure;

(c) turning the slider from an upright position, with the top member oriented over the legs, to a side position by moving the slider along a holding chute in the loading rack;

(d) automatically moving the slider from an initial position toward the zipper closure along a curved path by using a rotating rotor having an outer periphery and at least one slider-engaging shoulder extending from the outer periphery and adjacent to a pocket accommodating the slider to push the slider from the initial position toward the zipper closure;

(e) while moving the slider, flexing apart the legs of the slider;

(f) while the legs are flexed apart, mounting the slider onto the zipper closure so that the legs straddle the tracks and the top member is oriented on the top edges of the tracks; and (g) allowing the legs to return to a pre-flexed position so that the hooks on the legs engage the bottom shoulders of the tracks.

20. The method of claim 19 wherein the step of flexing apart the legs of the slider includes moving the slider along an insertion wedge having a leading edge and trailing edge, with the legs of the slider straddling the wedge, the wedge increasing in thickness from the leading edge to the trailing edge.

21. The method of claim 20 wherein the step of automatically moving the slider includes using the rotating rotor to push the slider from the initial position, along a curved path, to and along the insertion wedge, and then onto the zipper closure.

22. The method of claim 19 wherein the step of mounting the slider includes moving the slider onto the zipper closure and under a guide finger to prevent the slider from moving upwardly away from the zipper closure.

23. The method of claim 19 wherein the step of automatically moving the slider includes moving the slider along a curved path at least 90° from the initial position to the zipper closure.

24. The method of claim 19 wherein the step of automatically moving the slider includes moving the slider along a curved path at least 150° from the initial position to the zipper closure.

25. The method of claim 19 wherein the step of moving the slider along a curved path includes moving the slider along a plane horizontally oriented relative to a ground surface.

26. A method of mounting a slider onto a recloseable plastic zipper closure having interlocking tracks, the method comprising:

(a) providing a recloseable plastic zipper closure with interlocking tracks, the tracks having top edges and bottom shoulders;

(b) providing a slider from a loading rack; the slider having a top member and a pair of spaced legs depending from the top member; the legs having opposing hooks; the slider being constructed and arranged to release and interlock the interlocking tracks, as the slider is moved relative to the zipper closure;

(c) allowing the slider to fall by gravity from the loading rack into the insertion pocket of the rotor, the insertion pocket formed by an outer contour of a rotor and a pair of walls on opposite sides of the rotor;

(d) moving the slider from an initial position toward the zipper closure along a curved path by using a rotating rotor having an outer periphery and at least one slider-engaging shoulder extending from the outer periphery and adjacent to a pocket accommodating the slider to push the slider from the initial position toward the zipper closure;

(e) while moving the slider, flexing apart the legs of the slider;

(f) while the legs are flexed apart, mounting the slider onto the zipper closure so that the legs straddle the tracks and the top member is oriented on the top edges of the tracks; and (g) allowing the legs to return to a pre-flexed position so that the hooks on the legs engage the bottom shoulders of the tracks.

27. The method of claim 26 wherein the step of flexing apart the legs of the slider includes moving the slider along an insertion wedge having a leading edge and trailing edge, with the legs of the slider straddling the wedge, the wedge increasing in thickness from the leading edge to the trailing edge.

28. The method of claim 27 wherein the step of moving the slider includes using the rotating rotor to push the slider from the initial position, along a curved path, to and along the insertion wedge, and then onto the zipper closure.

29. The method of claim 26 wherein the step of mounting the slider includes moving the slider onto the zipper closure and under a guide finger to prevent the slider from moving upwardly away from the zipper closure.

30. The method of claim 26 wherein the step of moving the slider includes moving the slider along a curved path at least 90° from the initial position to the zipper closure.

31. The method of claim 26 wherein the step of moving the slider includes moving the slider along a curved path at least 150° from the initial position to the zipper closure.

32. The method of claim 26 wherein the step of moving the slider along a curved path includes moving the slider along a plane vertically oriented relative to a ground surface.

33. The method of claim 26 wherein the step of moving the slider along a curved path includes moving the slider along a plane horizontally oriented relative to a ground surface.

* * * * *